United States Patent [19]

Rosenthal et al.

[11] Patent Number: 4,834,386

[45] Date of Patent: May 30, 1989

[54] DICE GAME

[76] Inventors: Mark Rosenthal, 225 W. Walnut St., Long Beach; David Dardick, 18 Donna La., Lido Beach, both of N.Y. 11561

[21] Appl. No.: 109,746

[22] Filed: Oct. 19, 1987

[51] Int. Cl.[4] ..... A63F 9/04

[52] U.S. Cl. ..... 273/146

[58] Field of Search ..... 273/146

[56] References Cited

PUBLICATIONS

"Scarne's Encyclopedia of Games" by John Scarne, copyright 1973, published by Harper & Row, N.Y. pp. 483, 484, 488–491.

*Primary Examiner*—Anton O. Oechsle

*Attorney, Agent, or Firm*—Michael I. Kroll

[57] ABSTRACT

A method for a plurality of players each having a turn and a score to play a dice game using a plurality of dice and comprising the steps of throwing one die of the plurality of dice by each player of the plurality of players so as to decide which player of the plurality of players is the first player, throwing the plurality of dice in turn by each player of the plurality of players so that the dice game may begin, removing at least one die from the plurality of dice in turn by each player of the plurality of players so that each player may continue playing the turn, throwing in turn the remaining dice of the plurality of dice by each player of the plurality of players, throwing continually in turn the remaining dice of the plurality of dice by each player of the plurality of players until a score is reached and a decision to continue is made by each player of the plurality of players, and throwing the plurality of dice by each player of the plurality of players until a winning score is reached.

10 Claims, 1 Drawing Sheet

DICE GAME

BACKGROUND OF THE INVENTION

The present invention relates to dice games. More particularly, it relates to a dice game which is interesting, challenging, and competitive.

Many avenues of recreation are sought after. Most simple are the board games. Board games may involve a number of players, each competing to be the winner. However, the average board game involves a lot of playing pieces, intricate rules and scoring conditions, and some means for determining the advancement of each player.

SUMMARY OF THE INVENTION

Accordingly, it is an object of the present invention to provide a dice game which avoids the disadvantages of the prior art.

More particularly, it is an object of the present invention to provide a dice game which is interesting, challenging, competitive, and which can be played by a number of players.

In keeping with these objects, and with others which will become apparent hereinafter, one feature of the present invention resides, briefly stated in a method for a plurality of players each having a turn and a score and playing a dice game using a plurality of dice and which comprises the steps of throwing one die of the plurality of dice by each player of the plurality of players so as to decide which player of the plurality of players is the first player, throwing the plurality of dice in turn by each player of the plurality of players so that the dice game may begin, removing at least one die from the plurality of dice in turn by each player of the plurality of players so that each player may continue playing the turn, throwing in turn the remaining dice of the plurality of dice by each player of the plurality of players, throwing continually in turn the remaining dice of the plurality of dice by each player of the plurality of players until a score is reached and a decision to continue is made by each player of the plurality of players, and throwing the plurality of dice by each player of the plurality of players until a winning score is reached.

At any time during an individuals turn when all six dice have been used they may at their option decide to elect to cease or stop or on the other hand may continue to play by rerolling all six die, continuing to add to score until decision to stop or bust occurs.

In accordance with another feature of the present invention, the step of throwing the plurality of dice includes the throwing of up to six dice.

Another feature of the present invention is that the step of throwing the plurality of dice until a winning score is reached includes throwing the dice until at least 5000 points is reached.

Still another feature of the present invention is that the step of throwing the plurality of dice by each player of the plurality of players continues to the left.

Yet another feature of the present invention is that the step of removing at least one dice includes removing a one and/or a five or triple.

Still yet another feature of the present invention is that the step of throwing continuously the remaining dice includes reaching a score of 600 points.

Yet still another feature of the present invention is that the step of throwing the remaining dice includes throwing until the player "busts."

Another feature of the present invention is that the step of throwing the remaining dice until a player "busts" includes not throwing a one or a five or triple.

Still another feature of the present invention is that the step of throwing the plurality of dice includes throwing a "straight."

Finally, still a further feature of the present invention is that the step of throwing a "straight" includes throwing a one to six combination.

To the accomplishment of the above and related objects, this invention may be embodied in the form illustrated in the accompanying drawing, attention being called to the fact, however, that the drawing is illustrative only, and that changes may be made in the specifics illustrated and described within the scope of the appended claims.

The novel features which are considered characteristic for the invention are set forth in particular in the appended claims. The invention itself, however, to its method of operation, together with additional objects and advantages thereof, will be best understood from the following description of the specific embodiment.

DETAILED DESCRIPTION OF THE PREFERRED EMBODIMENT

Figure 1:
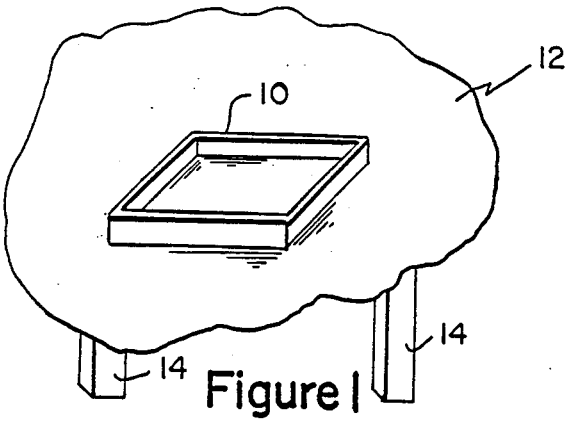
FIG. 1 is a perspective view of the present invention in play.

Referring now to FIG. 1, the playing box of the present invention is shown generally at 10, resting on a table top 12 of a table 14. Six dice 16 are shown within the confines of the playing box 10.

Figure 2:
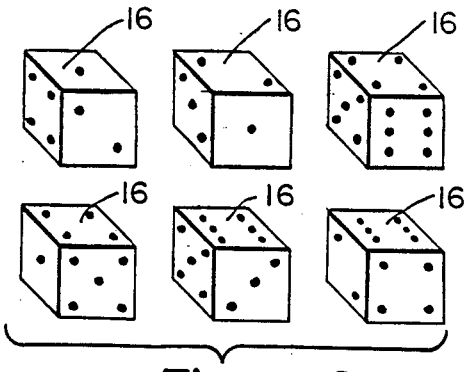
FIG. 2 is a perspective view of the dice used to exercise the present invention.

The six dice 16 of the present invention are shown generally in FIG. 2 and may be standard dice.

The rules of the game of the present invention will now be explained in detail with reference being made to the accompanying Figures.

The first player to accumulate at least 5000 points wins if the other players on their final throw cannot surpass that score.

Play begins by having each player, in turn, throw one die to see who goes first. Player with highest throw goes first with players to the left following.

At the beginning of each player's turn, the player throws all six dice. Subsequently, at least one dice must be removed so that the player may continue playing his turn, the dice thay may be removed being only the one's, five's or three of a kind(triplets).

Figure 3:
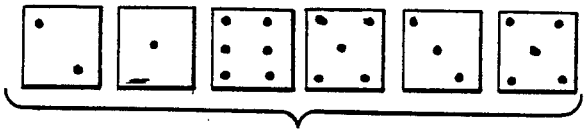
FIG. 3 shows one possible combination of dice being thrown.

As an example of how to remove dice and score, reference is made to FIG. 3. FIG. 3 shows one possible combination of dice being thrown. In this example, player would have to remove either the one, which is worth 100 points, or one or both of the fives which is worth 50 points each. This would depend upon strategy and how many dice the player decides to roll on his next turn. Bearing in mind that only at least one die is required to be removed in order for a player to continue playing his turn.

The player then rolls the remaining dice in hopes of getting at least a one, a five or a triple in order to continue playing his turn as these are the only dice that count towards a score.

Since 600 points are needed before points are accumulated and scoring begins, the player will continue to play his turn until he accumulates at least the needed 600 points. The player then elects to contiue playing his turn and attempt to accumulate points over said 600 points or he may decide to stop rolling and pass. Once a player obtains a score of at least 600 points(required to get on the scoring board or pad) player may keep any amount of additional points and may also stop at any score to protect the points already scored. This refers to only the first time a player accumulates points to be able to start scoring and in any subsequent turn any amount of points may be retained.

Each turn thereafter the player may choose how many points he wishes to retain by deciding how many dice he has left to play. All remaining dice not removed in a single throw must be thrown until all six are used up. A player may continue his turn until by voluntarily passes or he "busts".

"Busting" occurs when a player throwing any amount of dice does not get at least a one, a five, or a triple. If three of a kind is rolled, the point value is 100 times the face value of the die. When a player "busts," all accumulates points in that single turn or lost. Points previously accumulated are not lost.(Pairs are triple)

Once a player has "busted," his turn is over, and play resumes with the player to the left.

A player may roll numerous dice combinations amounting to various scoring possibilities.

Figure 4:
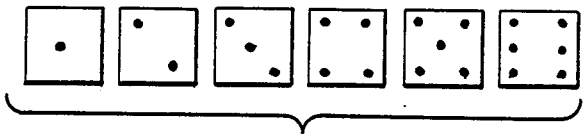
FIG. 4 shows the dice combination forming a "straight,"

For example, as shown in FIG. 4, a player may roll a "straight." A "straight" occurs when a player elects to throw all six dice and gets them in a one to six order. A "straight" is worth 1500 points. The player may stop rolling for this turn and accumulate his points or he may choose to reroll and risk "busting." If the player "busts," he loses his accumulated 1500 points from that turn. However, if the player gets at least a one, a five, or a triple, he may continue to throw the dice or decide to stop and keep his points accumulated from that turn.

Figure 5:
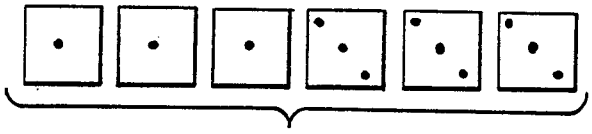

Three of a kind of twos, threes, fours, fives, and sixes are worth their individual face value times 100 when thrown during any one throw of the dice, that is threes are worth 300 and fours are worth 400 etc. An exception to this is the case of three ones which is worth 1000 points. Scoring the example shown in FIG. 5 involves three ones worth 1000 points and three threes worth 300 points, therefore making this roll worth 1300 points.

We will now look at an example turn of a player exercising the game of the present invention.

Figure 6:
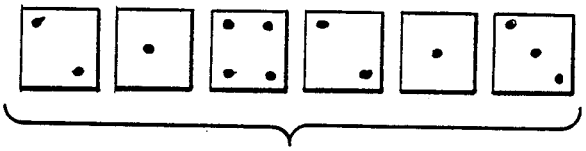
Figure 7:
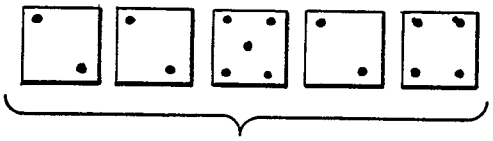
Figure 8:
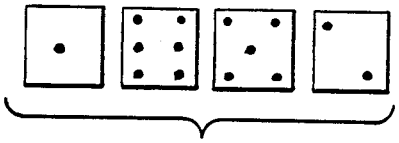
Figure 14:
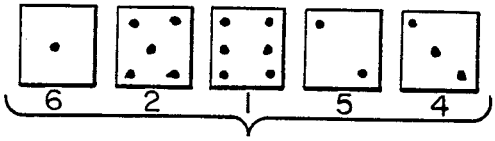
FIG. 14 shows the dice combination explaining a "bottom."

The player rolls all six dice and throws the combination shown in FIG. 6. The player may take one or both ones. He decides to take only one one worth 100 points. Since he threw a one he did not "bust" and may roll again. In his second roll he threw the combination shown in FIG. 7. The player may take the three twos worth 200 points and/or the one five worth 50 points. He decides to take the one five. He now has a score of 150 points, so far, for thiis turn. Since he threw a five he did not "bust" and may roll again. In his third roll, the throws the combination shown in FIG. 8**. The player may take the one or the five, or both and either stop or reroll the remaining dice. Since he threw a one or a five, he did not bust and may roll again. He may stop or reroll the remaining dice. If he decides to reroll the remaining dice, his turn continues until he uses all of the dice, voluntarily stops to avoid a "bust," or "busts." If he "busts," he loses all the points accumulated in that turn. If he uses all dice he starts again with all six dice.

*Depending on strategy 3 dice rerolled may be worth more than 200 points

During any roll of at least three dice, if a player rolls or is left with after removing all but the last three dice, a matching pair and a one or a five, the one or the five becomes "wild" and matches the existing pair and creates three of a kind. Scoring is then 100 times the face value of the pair. Examples of this are shown in FIGS. 9 through 13.

Figure 9:
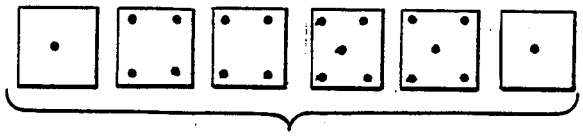
FIGS. 5 through 13 show other possible combinations of dice being thrown.

The example shown in FIG. 9 involves the throwing of all six dice. The player first removes the two ones and a five, which whould be worth 250 points and would leave the two fours and the five. The five is "wild" and becomes a four and therefore makes three of a kind worth 400 points. This roll would be worth 650 points in total. The player may stop and keep his accumulated points or may continue by throwing all six dice again.

Figure 10:
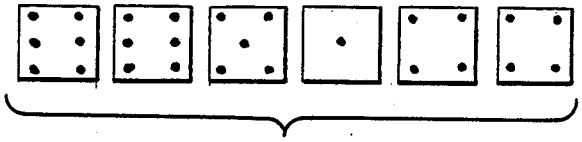

The example shown in FIG. 10 also involves the throwing of all six dice. The player first removes a one or a five or both to continue his turn. However, no three of a kind would be usable since "wild" ones and fives are only usable with last three dice.

Figure 11:
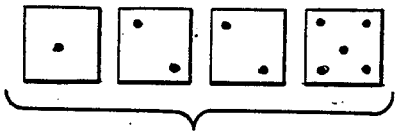

The example shown in FIG. 11 involves the throwing of four dice. The player first removes the one worth 100 points. The remaining two twos and one five are worth 200 points and therefore makes a total score of 300 points for this roll.

Figure 12:
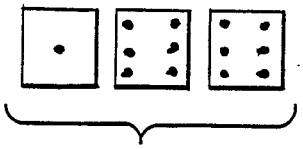

The example shown in FIG. 12 involves the throwing of three dice. This roll is worth 600 points.

Figure 13:
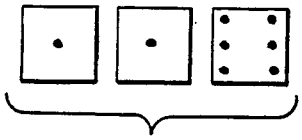

The example shown in FIG. 13 also involves the throwing of three dice. This roll is worth only 200 points simply because the ones are not "wild." This is so because there is only one six. However, if the six were a five, the roll would be worth 1000 points for the three ones because the five would be "wild" making three of a kind.

To be able to use a one or a five as a "wild" die, it has to be left with a matching pair of dice.

When throwing all six dice at one time and player "busts," the player then loses half of his total score and any accumulated points of that turn. Play then resumes with player to the left. If player falls under 600 points on total score, he then loses all his accumulated points and must then again score 600 points in order to start accumulating a score.

When splitting points for a "bust" the result is rounded off to the nearest five, as for example, if busting of six dice occurs more than once to a player the result is a fraction number and is then rounded off to the next highest multiple of five.

If when throwing any number of dice, a die rests on an angle against one of the walls or another die or leaves the playing board area then all dice thrown on that play are re-rolled with no penalty or loss of points.

When a player "busts" with less than six dice, he only loses that turn and the accumulated points of that turn.

An optional call of "bottoms" or "bots" may be made before a player throws the dice of any turn. This allows the player to receive the number on the dice that is resting on the playing board. That is, the number under the number facing up. An example is illustrated in FIG. 4. The "bots" call on this throw would make the one a six, the five a two, the six a one, the two a five and the three a four.

The first player to get at least 5000 points totally accumulated when he finishes his turn, must wait for each of the other players to get one last turn in an attempt to beat the score or "bust" trying. A player who "busts" trying to beat the at least 5000 point player's score may not necessarily be out of the game. This is so, because if any of the other players beats the at least 5000 point player's score, all of the players then get another chance. This is called an "extended play" and ends when all of the players finally "bust" trying to beat the at least 5000 point player's score. The game continues as long as some player beats the existing highest score. During "extended play," a player who is far behind in points may elect to stop at any given time while collecting points in the hope that the next player will beat the player who went over 5000 points.

It will be understood that each of the elements described above, or two or more together, may also find a useful application in other types of methods differing from the type described above.

While the invention has been illustrated and described as a dice game, it is not intended to be limited to the details above, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims.

What is claimed is:

1. A method for a plurality of players each having a turn and a score to play a dice game using a plurality of dice, comprising the steps of:

(a) throwing one die of the plurality of dice by each player of the plurality of players so as to decide which player of the plurality of players is the first player;

(b) calling "bottoms" if so desired by the player of the plurality of players whose turn it is before he throws the dice so that said player of the plurality of players will receive the number on the dice that is the number under the number facing up;

(c) throwing the plurality of dice in turn by each player of the plurality of players as the dice game progresses;

(d) removing at least one die or triple from the plurality of dice in turn by each player of the plurality of players so that each player may continue playing the turn and crediting the throwing player with a predetermined score for each die and/or triple removed, said at least one die having a predetermined number facing upwardly or a predetermined number under the number facing up if the "bottoms" option had been exercised, and the triple being three dice having any same number facing upwardly, or any same number under the number facing up if the "bottoms" option had been exercised;

(e) throwing in turn the remaining dice of the plurality of dice by each player of the plurality of players;

(f) throwing continually in turn the remaining dice of the plurality of dice by each player of the plurality of players until a score is reached and a decision to continue or stop is made by each player of the plurality of players; and (h) throwing the plurality of dice by each player of the plurality of players until a winning score is reached.

2. A dice game as defined in claim 1, wherein said step of throwing the plurality of dice includes the throwing of up to six dice.

3. A dice game as defined in claim 1, wherein said step of throwing the plurality of dice until a winning score is reached includes throwing the dice until at least 5000 points is reached wherein ones are credited with a score of 100 points each, fives are credited with a score of 50 each, and triples are credited with a score of 100 times times the face value of a single one of the dice forming the triple.

4. A dice game as defined in claim 1, wherein said step of throwing the plurality of dice by each player of the plurality of players continues to the left.

5. A dice game as defined in claim 1, wherein said step of removing at least one die includes removing at least one one and/or at least one five and/or at least one triple.

6. A dice game as defined in claim 1, wherein said step of throwing continuously the remaining dice includes reaching a score of 600 points to start scoring wherein ones are credited with a score of 100 points each, fives are credited with a score of 50 each, and triples are credited with a score of 100 times the face value of a single one of the dice forming the triple.

7. A dice game as defined in claim 1, wherein said step of throwing the remaining dice includes throwing until the player "busts" or decides to stop.

8. A dice game as defined in claim 7, wherein said step of throwing the remaining dice until a player "busts" includes not throwing a one or a five or a triple.

9. A dice game as defined in claim 1, wherein said step of throwing the plurality of dice includes throwing a "straight."

10. A dice game as defined in claim 9, wherein said step of throwing a "straight" includes throwing a one six combination.

* * * * *